US008376201B2

(12) United States Patent
Wrigley et al.

(10) Patent No.: US 8,376,201 B2
(45) Date of Patent: Feb. 19, 2013

(54) SHOULDER STRAP

(75) Inventors: Gordon Wrigley, Tyne and Wear (GB); Paul Townsend, Northumberland (GB)

(73) Assignee: Draeger Safety UK Limited, Blyth (Northumberland) (GB)

( * ) Notice: Subject to any disclaimer, the term of this patent is extended or adjusted under 35 U.S.C. 154(b) by 326 days.

(21) Appl. No.: 12/774,067

(22) Filed: May 5, 2010

(65) Prior Publication Data

US 2010/0282797 A1 Nov. 11, 2010

(30) Foreign Application Priority Data

May 6, 2009 (GB) ..... 0907751.2

(51) Int. Cl.
*A45F 3/04* (2006.01)

(52) U.S. Cl. ..... 224/628; 224/647

(58) Field of Classification Search ..... 224/600–622, 224/627–659, 257–264
See application file for complete search history.

(56) References Cited

U.S. PATENT DOCUMENTS

| | | | | |
|---|---|---|---|---|
| 3,799,413 | A | 3/1974 | McBain | |
| 5,044,538 | A | 9/1991 | Bader | 224/258 |
| 5,406,942 | A | 4/1995 | Loo | 128/100.1 |
| 5,586,705 | A | 12/1996 | Leonard | |
| 6,290,114 | B1 | 9/2001 | Berberian | |
| 7,752,722 | B2 * | 7/2010 | Calkin | 24/632 |
| 7,971,763 | B2 * | 7/2011 | Chace | 224/259 |
| 8,113,399 | B2 * | 2/2012 | Lee | 224/578 |
| 2002/0084296 | A1 * | 7/2002 | Roscoe-Dare | 224/259 |
| 2006/0102675 | A1 * | 5/2006 | Bezak et al. | 224/628 |
| 2012/0074191 | A1 * | 3/2012 | Fisher et al. | 224/627 |

FOREIGN PATENT DOCUMENTS

| | | | |
|---|---|---|---|
| DE | 8333902 | U1 | 5/1984 |
| DE | 297 04 328 | | 5/1997 |
| DE | 20 2005 016810 | | 5/2006 |
| FR | 2630897 | A1 | 11/1989 |
| GB | 2236471 | A | 10/1991 |

OTHER PUBLICATIONS

Search report under Section 17 for GB0907751.2, date of search Aug. 25, 2009, 1 p.

* cited by examiner

*Primary Examiner* — Justin Larson
(74) *Attorney, Agent, or Firm* — DLA Piper LLP (US)

(57) ABSTRACT

A shoulder strap for a harness for breathing apparatus includes a first elongate strap portion generally extending along a first longitudinal axis; a second elongate strap portion attached to the first strap portion and generally extending along a second longitudinal axis that is oblique to the first axis; and a first attachment portion for attaching a first end of the shoulder strap to the harness in use and a second attachment portion for attaching a second end of the shoulder strap to the harness in use.

13 Claims, 6 Drawing Sheets

SHOULDER STRAP

This application is a utility application which claims the priority of United Kingdom Patent Application No. GB 0907751.2, filed May 6, 2009 incorporated herein by reference in its Entirety.

BACKGROUND OF THE INVENTION

The present invention relates to a shoulder strap, in particular, a shoulder strap for use in a harness.

Self-contained breathing apparatus (SCBA) harnesses comprise a structural support member, in the form of a back plate (or frame) to which a cylinder of breathable gas is mounted. Typically two flexible shoulder straps are each attached at a first end to an upper portion of the back plate and at a second end to a lower portion of the back plate. A flexible waist strap (or belt) is also attached to the back plate. This enables the harness to be carried on the back of a user.

It is known to use curved shoulder straps. The curved nature of the straps ensures that they can be attached to the upper and lower portion of the back plate, such that when the harness is worn by a user, the straps do not become overly twisted. This ensures that the harness is comfortable to wear. The curved straps are usually cut from a sheet of foam material and then a textile covering is applied.

Whilst these known straps are comfortable, they are expensive to manufacture and are relatively heavy. This means that they are not particularly suitable for low-cost and/or low-weight harnesses.

Embodiments of the present invention aim to address at least some of the above problems.

SUMMARY OF THE INVENTION

According to a first aspect of the invention there is provided a shoulder strap for a harness for breathing apparatus, comprising: a first elongate strap portion generally extending along a first longitudinal axis; a second strap portion attached to the first strap portion and generally extending along a second longitudinal axis that is oblique to the first axis; and a first attachment portion for attaching a first end of the shoulder strap to a harness for breathing apparatus and a second attachment portion for attaching a second end of the shoulder strap to a harness for breathing apparatus.

Preferably the first and second strap portions partially overlap. The first and second strap portions may be of the same constant width. In a particularly preferred arrangement the first and second strap portions are part of a single continuous piece of material.

In one embodiment the continuous piece of material comprises the first strap portion which is contiguous with a intermediate strap portion which itself is contiguous with the second strap portion; and the continuous piece of material comprises a first fold between the first strap portion and the intermediate strap portion and a second fold between the intermediate strap portion and the second strap portion such that the second strap portion is oblique to the first strap portion. The first and/or second fold may form a loop that is arranged such that an accessory can be attached to the strap.

In one embodiment a first edge of the shoulder strap has a first opening and the second edge of the shoulder strap has a second opening such that an accessory having first and second projections substantially facing towards each other can be detachably attached to the shoulder strap by locating the first and second flanges in the first and second openings respectively. The first and second openings may be formed between overlapping first and second portions of material. Preferably the first and second overlapping portions of material are formed by folding a continuous piece of material.

The first and second strap portions may be held in relative juxtapositions by stitching.

An end of the second strap portion not attached to the first strap portion may be provided with an attachment device to which a length-adjustment strap portion is attached. The attachment device may be a buckle. The overall length of the shoulder strap may be varied by adjusting the position at which the length-adjustment strap portion is attached to the attachment device.

The invention also concerns a harness for breathing apparatus comprising a shoulder strap according to any statement herein.

The invention may comprise any combination of the features and/or limitations referred to herein, except combinations of such features as are mutually exclusive.

BRIEF DESCRIPTION OF THE DRAWINGS

Embodiments of the present invention will now be described, by way of example, with reference to the accompanying drawings, in which.

DESCRIPTION OF EMBODIMENTS OF THE INVENTION

Figure 1:
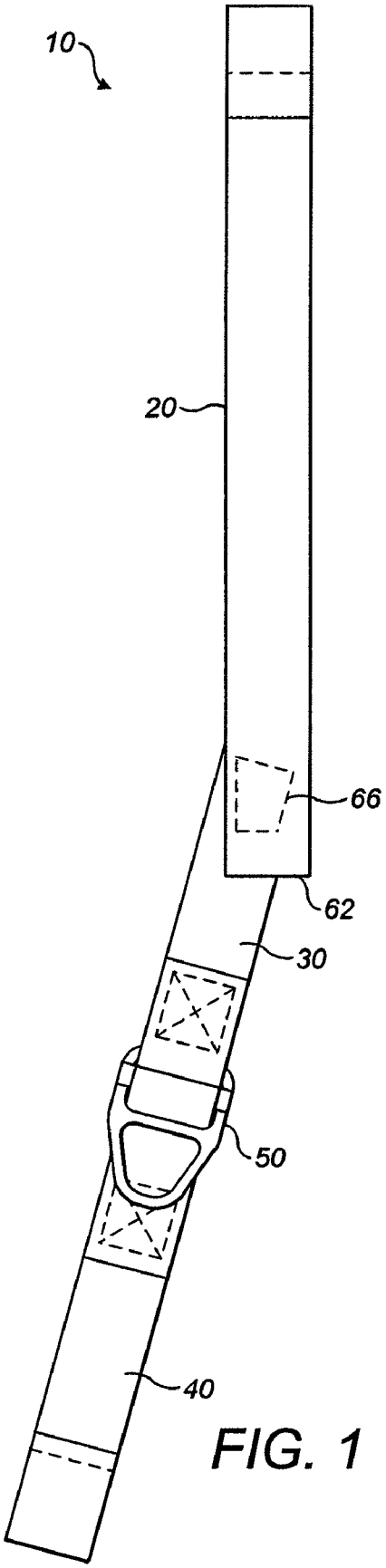
FIG. 1 schematically shows a shoulder strap according to an embodiment of the present invention.

As shown in FIG. 1, a shoulder strap 10 according to an embodiment of the present invention comprises a first elongate strap portion 20, a second elongate strap portion 30 and a length-adjustment strap portion 40.

The first strap portion 20 extends in a first direction along a first longitudinal axis and the second strap portion 30 extends in a second direction along a second longitudinal axis that is oblique to the first axis. The angle between the first and second directions is, in this embodiment, approximately 20°. However, other angles could be chosen during manufacture as will be described.

An attachment device 50 in the form of a buckle is provided at the end of the second strap portion 20. The length-adjustment strap portion 40 is attached to the second strap portion 30 using the buckle 50. The buckle 50 allows the length of the length-adjustment strap portion 40, extending from the second strap portion 30, to be varied, thus varying the overall length of the shoulder strap 10.

Figure 2:
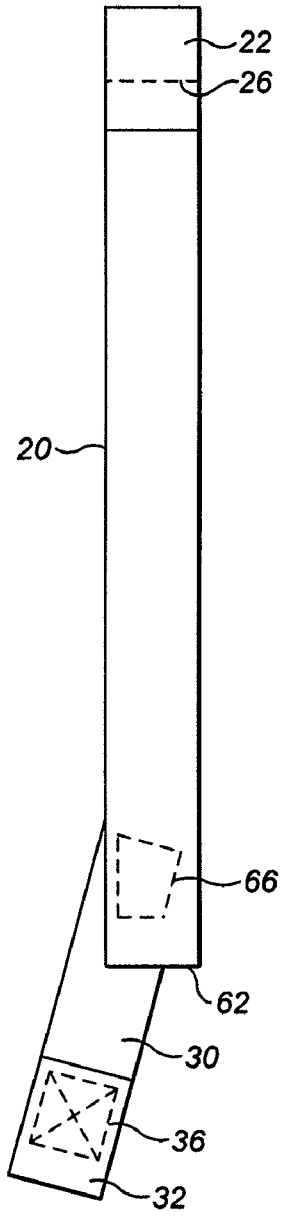
FIG. 2 schematically shows the first and second strap portions of FIG. 1.
Figure 3:
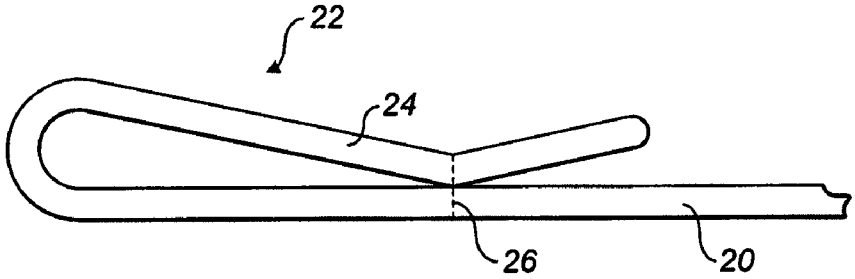
FIG. 3 schematically shows a loop at the end of the first strap portion.

FIG. 2 shows the first and second strap portions 20, 30 alone. The end of the first strap portion 20 is provided with a loop 22 that allows the end of the shoulder strap 10 to be attached to a back plate of a harness for breathing apparatus. Referring to FIG. 3, the loop 22 is formed by folding over a portion of the strap 24 and stitching a seam 26 on the folded-over portion. The end of the second strap portion 30 is also provided with a loop 32 to which the buckle 50 is attached. The loop is also formed by stitching a seam 36 on a folded-over portion of strap.

The first and second strap portions 20, 30 are formed from a continuous piece of strap material having a constant width. The continuous piece of strap material is folded and stitched such that the longitudinal extent, or axis, of the first strap portion 20 is oblique to that of the second strap portion 30.

Figure 4A:
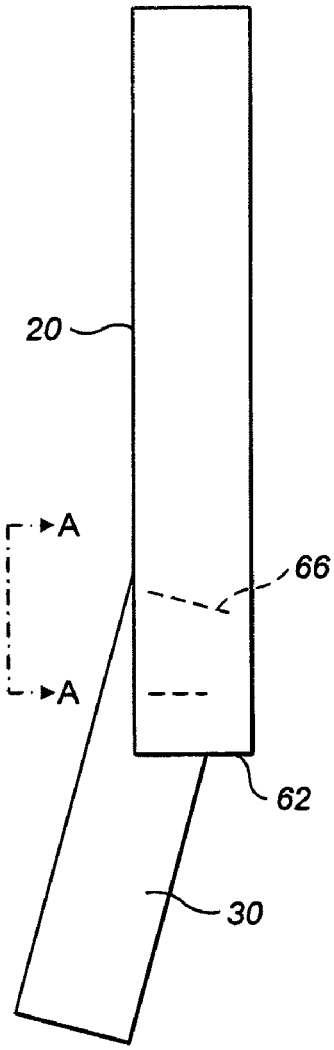
FIGS. 4A and B schematically show front and back enlarged views of folds between first and second strap portions.
Figure 4B:
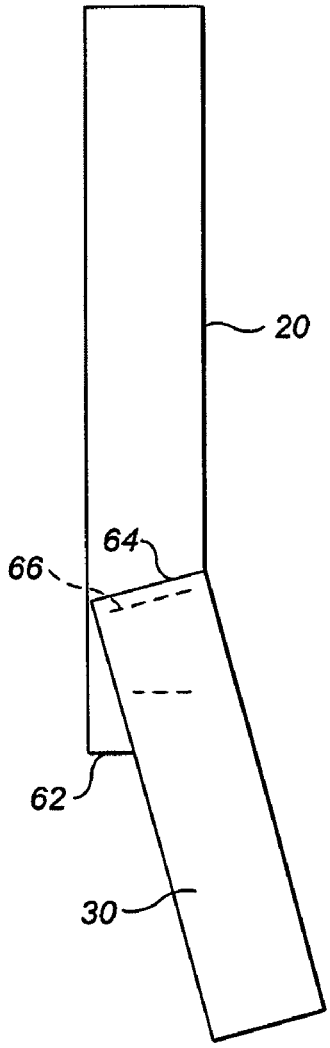
Figure 5:
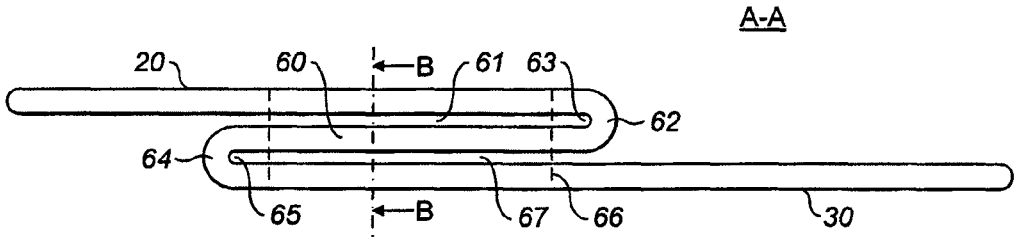
FIG. 5 schematically shows a view A-A of FIG. 4.

FIGS. 4A and B show front and back enlarged views of the folded strap. As can be seen from FIG. 5, the first strap portion 20 is contiguous (shares a boundary) with an intermediate strap portion 60 which is itself contiguous with the second strap portion 30. The intermediate strap portion 60 is folded back 62 on the first strap portion 20 and then the second strap portion 30 is folded back 64 on the intermediate strap portion 60 at an angle such that the second strap portion 30 is oblique to the first strap portion 30. The fold is then stitched at seam 66 in order to secure it.

The first fold 62 between the first and intermediate strap portions 20, 60 forms a first loop 63 which allows an accessory, such as a D-ring 80 (see FIG. 9), to be attached to the shoulder strap 10. The second fold 64 between the second and intermediate strap portions 30, 60 forms a second loop 65 which also allows an accessory to be attached to the shoulder strap 10.

Figure 6:
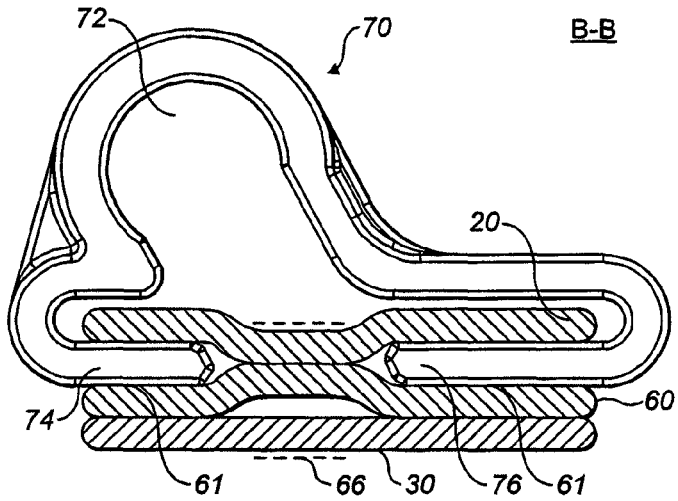
FIG. 6 schematically shows a cross-section B-B of FIG. 5 with a hose retention clip attached.

The fold 62 between the first and intermediate strap portions 20, 60 also forms an opening 61 at either edge of the strap. As shown in FIG. 6 (and FIG. 9), a hose retention clip 70 comprising a hose retaining portion 72 and first and second inwardly protruding flanges 74, 76 can be attached to the strap by locating the flanges 74, 76 in the openings 61 either side of the strap. The stitched seam 66 in the region of the folds 62, 64 prevents the hose clip 70 from sliding up and down the strap. The fold 64 between the second and intermediate strap portions 30, 40 also provides openings 63 either side of the strap.

Figure 7:
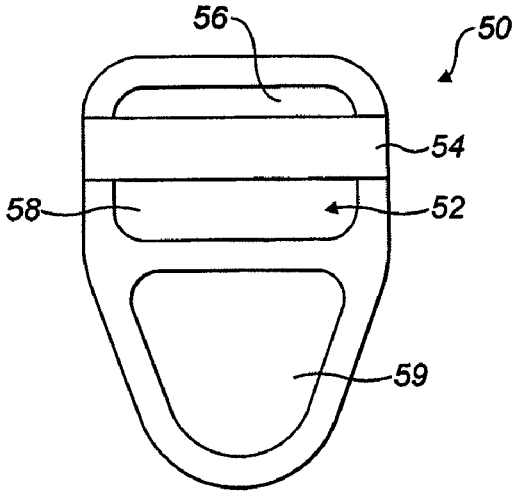
FIG. 7 schematically shows a buckle.

With reference to FIG. 7, the buckle 50 attached to the end of the second strap portion 30 comprises an opening 52 and a sliding bar 54. The sliding bar 54 is free to move up and down the opening 52 and divides the opening 52 into first and second 56, 58 openings. A D-ring 59 is also provided at the end of the buckle 50.

Figure 8:
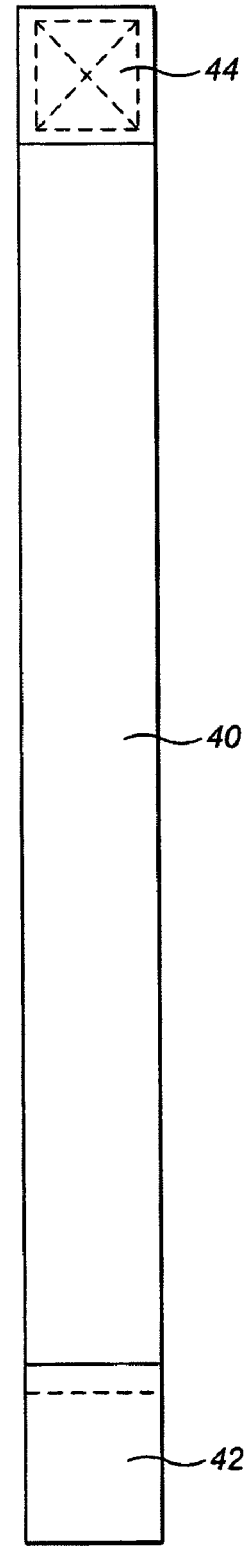
FIG. 8 schematically shows a length-adjustment strap portion.

FIG. 8 shows the length-adjusting strap 40. The strap 40 comprises a loop 42 at one end that allows the end of the shoulder strap 10 to be attached to a back plate of a harness for breathing apparatus. The loop 42 is formed in a similar way to the loops 22, 32 of the first and second strap portions 20, 30. The other end of the length-adjusting strap 40 comprises a folded over tab 44 that is stitched to prevent the strap 40 from fraying.

The length-adjusting strap 40 is attached to the end of the second strap portion 30 using the buckle. The tab 44 is passed through the first opening 56 of the buckle 50, over the sliding bar 54 and then through the second opening 58. When the looped end of the length-adjusting strap 40 is pulled, the bar 54 is caused to move downwards towards the second opening 58. This traps the strap 40 in the opening and prevents relative movement between the second strap portion 30 and the length-adjusting strap portion 40. To shorten the overall length of the shoulder strap 10, the tab 44 of the length-adjusting strap 40 is pulled which causes the strap 40 to pull through the buckle 50. To lengthen the overall length of the shoulder strap 10, the end of the D-ring 59 is lifted which allows the length-adjusting strap 40 to be pulled through the buckle 50 in the opposite direction.

Figure 9:
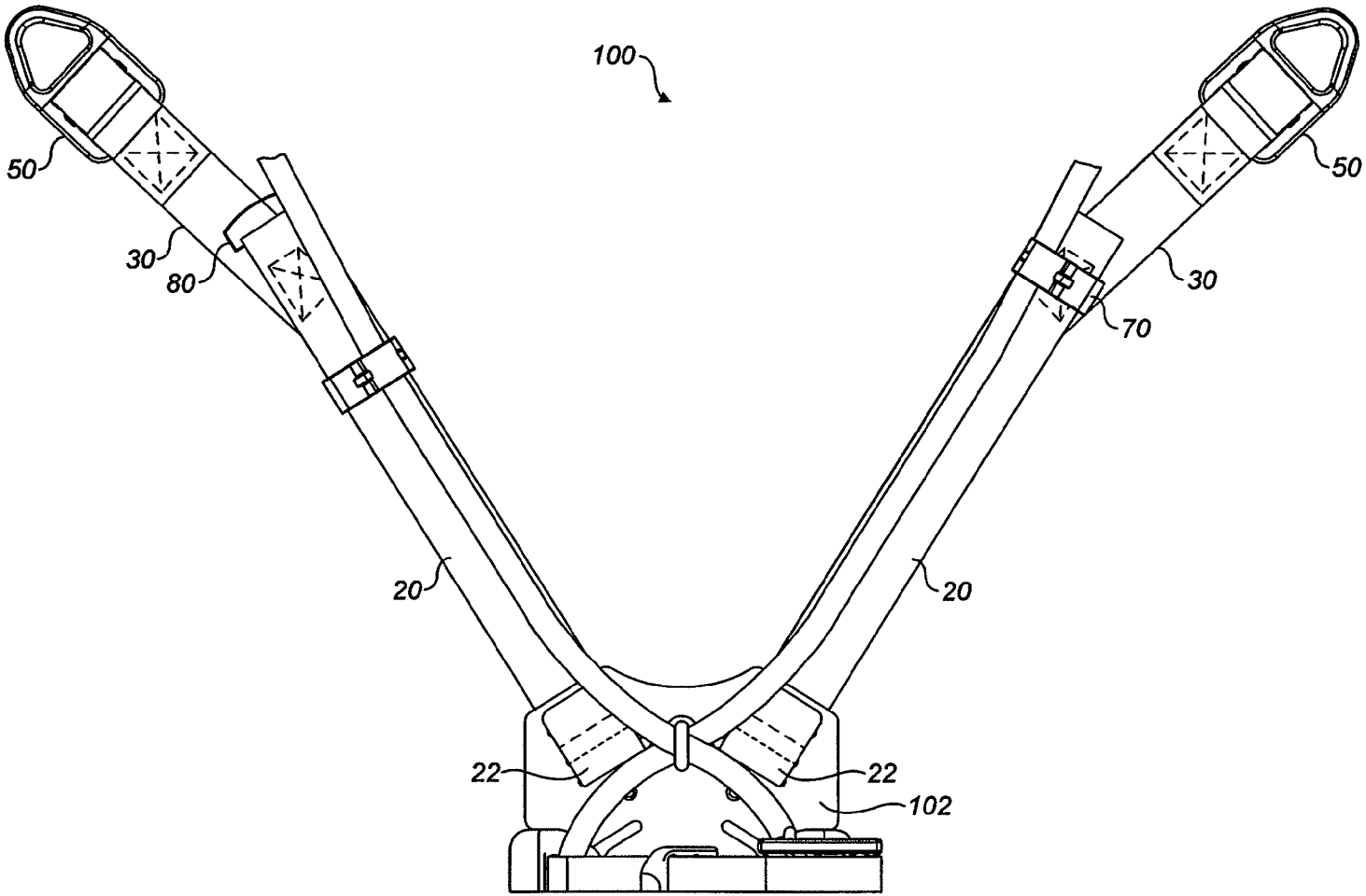
FIG. 9 schematically shows an upper part of a harness for breathing apparatus comprising a pair of the shoulder straps of FIG. 1.
Figure 10:
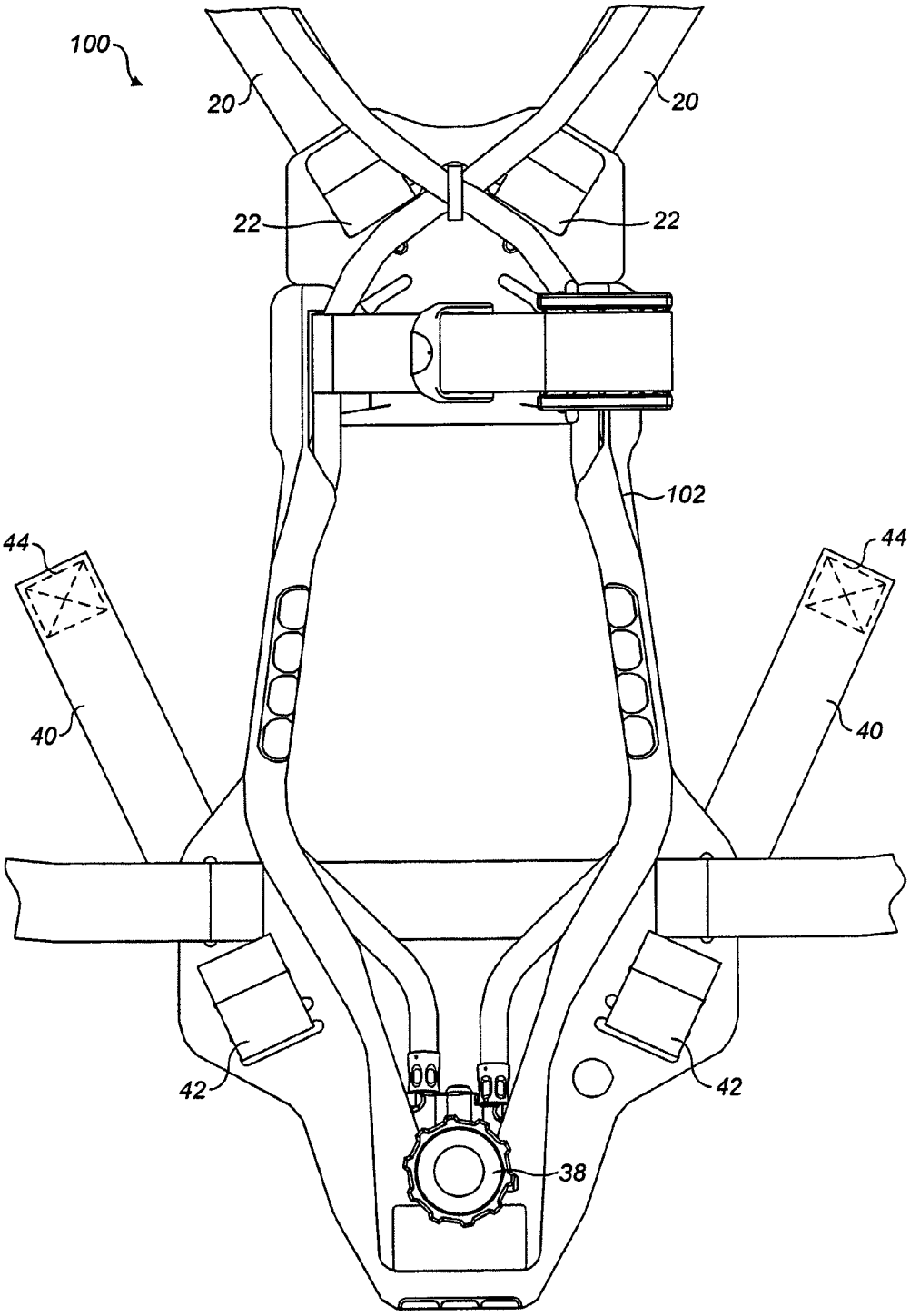
FIG. 10 schematically shows a lower part of a harness for breathing apparatus comprising a pair of shoulder straps of FIG. 1.

FIGS. 9 and 10 show two shoulder straps 10 according to an embodiment of the present invention attached to a back plate (or frame) 102 of a harness 100 for breathing apparatus. The two shoulder straps 10 are identical except they are mirror images of one another, i.e. the second strap portions 30 are inclined to the first strap portions 20 in opposite directions.

As can be seen in FIG. 8, the looped end 22 of the first strap portion 20 is attached to an upper portion of the back plate 102. This is done by locating opposed prongs (not shown), which are part of the back plate in the loop 22. As shown in FIG. 9, the looped end 42 of the length-adjusting strap portion 40 is attached to a lower portion of the back plate 102. Again, this is done by locating another pair of opposed prongs (not shown) in the loop 42.

The tabs 44 of the length-adjusting strap portions 40 are then fed through the openings in the buckles 50 as described above. The overall length of each shoulder strap 10 is adjustable by either pulling the tab 44, so as to pull the length-adjusting strap portion 40 through the buckle 50, or by lifting the D-ring 59 of the buckle 50 so as to release a portion of the length-adjusting strap portion 40.

Since the first and second strap portions 20, 30 are formed by folding and stitching a continuous piece of material, even if in the unlikely event that the stitching were to fail, the first and second strap portions could not become detached from each other. This improves the safety of a harness comprising the shoulder strap.

Having the first and second strap portions 20, 30 oblique to one another improves the comfort of the harness. The first strap portion 20 extends from an upper portion of the back plate, across the shoulder of the wearer. The second strap portion 30 then extends from the first strap portion 20 obliquely towards the side and under the arm of the wearer. It is then coupled to the back plate either directly or via a length-adjustment portion 40. The oblique nature of the first and second strap portions 20, 30 helps to ensure that the shoulder strap 10 does not become twisted, which would make it less comfortable for the wearer.

The folds 62, 64 between the first strap portion 20, intermediate strap portion 60 and the second strap portion 30, and the stitching that secures the folds, provides convenient pockets (or openings) to which an accessory, such as a hose clip 70, can be attached.

The manufacture of the shoulder strap 10 is also particularly quick and is relatively inexpensive. This is largely due to a single piece of continuous strap being folded and stitched (or otherwise secured) to form the first and second oblique strap portions 20, 30. The loops 22, 32, 42 are also folded and stitched which allows quick manufacture.

The invention claimed is:

1. A shoulder strap for a harness for breathing apparatus, comprising:

a back plate or frame;

a first elongate strap portion generally extending along a first longitudinal axis;

a second elongate strap portion attached to the first strap portion by stitching so as to generally extend along a second longitudinal axis that is oblique to the first axis; and a first attachment portion for attaching a first end of the shoulder strap to the harness in use and a second attachment portion for attaching a second end of the shoulder strap to the harness in use, wherein the first strap portion on is arranged to extend from an upper portion of the back plate or frame across the shoulder of a wearer and the second strap portion is arranged to extend from the first strap portion obliquely towards the side and under the arm of the wearer; and wherein the first and second strap portions are part of a single continuous piece of material.

2. A shoulder strap according to claim 1, wherein the first and second strap portions partially overlap.

3. A shoulder strap according to claim 1, wherein the first and second strap portions are of the same constant width.

4. A harness for breathing apparatus comprising a shoulder strap according to claim 1.

5. A shoulder strap according to claim 1, wherein the continuous piece of material comprises the first strap portion which is contiguous with an intermediate strap portion which itself is contiguous with the second strap portion; and wherein the continuous piece of material comprises a first fold between the first strap portion and the intermediate strap portion and a second fold between the intermediate strap portion and the second strap such that the second strap portion is oblique to the first strap portion.

6. A shoulder strap according to claim 5, wherein the first fold forms a first loop that is arranged such that an accessory can be attached to the strap.

7. A shoulder strap according to claim 5, wherein the second fold forms a second loop that is arranged such that an accessory can be attached to the strap.

8. A shoulder strap according to claim 1, wherein a first edge of the shoulder strap has a first opening and the second edge of the shoulder strap has a second opening such that an accessory having first and second projections substantially facing towards each other can be detachably attached to the shoulder strap by locating the first and second flanges in the first and second openings respectively.

9. A shoulder strap according to claim 8, wherein the first and second openings are formed between overlapping first and second portions of material.

10. A shoulder strap according to claim 9, wherein the first and second overlapping portions of material are formed by folding the continuous piece of material.

11. A shoulder strap according to claim 1, wherein an end of the second strap portion not attached to the first strap portion is provided with an attachment device to which an length-adjustment strap portion is attached.

12. A shoulder strap according to claim 11, wherein the attachment device is a buckle.

13. A shoulder strap according to claim 11, wherein the overall length of the shoulder strap can be varied by adjusting the position at which the length-adjustment strap portion is attached to the attachment device.

* * * * *